US011717717B1

(12) United States Patent
Polovin et al.

(10) Patent No.: US 11,717,717 B1
(45) Date of Patent: Aug. 8, 2023

(54) YOGA BLOCK WITH STRUCTURAL SUPPORT HANDLE

(71) Applicant: Treowe Legal, Inc., Deerfield, IL (US)

(72) Inventors: Andrew K. Polovin, Deerfield, IL (US); Ilan Pinkus, Scottsdale, AZ (US)

(73) Assignee: Treowe Legal, Inc., Deerfield, IL (US)

( * ) Notice: Subject to any disclaimer, the term of this patent is extended or adjusted under 35 U.S.C. 154(b) by 0 days.

(21) Appl. No.: 18/106,303

(22) Filed: Feb. 6, 2023

(51) Int. Cl.
*A63B 21/00* (2006.01)
*A63B 23/14* (2006.01)
*A63B 23/00* (2006.01)

(52) U.S. Cl.
CPC ..... *A63B 21/4035* (2015.10); *A63B 23/14* (2013.01); *A63B 2023/006* (2013.01)

(58) Field of Classification Search
CPC ..... A63B 21/4035; A63B 23/14; A63B 2023/006
See application file for complete search history.

(56) References Cited

U.S. PATENT DOCUMENTS 6,739,004 B1 5/2004 Abrahamsen et al.
7,156,791 B2 * 1/2007 Edwards ..... A63B 21/4035 482/148
8,052,587 B1 * 11/2011 Wu ..... A63B 23/0458 482/148
D733,230 S * 6/2015 Mallory ..... D21/686
D740,378 S * 10/2015 Walsh-Gomez ..... D21/662
9,925,408 B1 * 3/2018 Murdock ..... A63B 21/4043
D872,199 S * 1/2020 Krishock ..... D21/686
11,213,710 B2 * 1/2022 Kibby ..... A63B 23/00
2007/0167301 A1 * 7/2007 Evans ..... A63B 21/00047 482/148
2007/0287608 A1 * 12/2007 Hallar ..... A63B 21/072 482/104
2008/0023355 A1 * 1/2008 Reynolds ..... A63B 71/0036 206/315.1
2009/0023563 A1 * 1/2009 Liang ..... A63B 21/072 482/106
2009/0247378 A1 * 10/2009 Carlesimo ..... A63B 26/00 482/141
2010/0240509 A1 * 9/2010 Chen ..... A63B 21/00047 482/148
2013/0274078 A1 10/2013 Andrews
2015/0352397 A1 * 12/2015 Essapen ..... A63B 21/068 482/128
2019/0009137 A1 * 1/2019 Trevino ..... A63B 21/068
2020/0346065 A1 * 11/2020 Dalcourt ..... B29C 45/261
2022/0249903 A1 * 8/2022 Cotton ..... A63B 23/1236

* cited by examiner

*Primary Examiner* — Andrew S Lo
(74) *Attorney, Agent, or Firm* — Lee Sullivan Shea & Smith LLP

(57) ABSTRACT

An example yoga block includes a handle coupled to a body portion of the yoga block. The handle is at least partially positioned in a concavity of the body portion. The handle includes a structural support that is embedded in the body portion of the yoga block. The structural support allows for a larger concavity in the body portion of the yoga block without compromising the structural integrity of the yoga block, which may provide an improved gripping experience when using the yoga block to practice yoga.

20 Claims, 6 Drawing Sheets

YOGA BLOCK WITH STRUCTURAL SUPPORT HANDLE

BACKGROUND

Yoga exercises, also known as asanas, are performed by assuming different postures and positions with the body. These postures are designed to stretch and strengthen different muscle groups and improve flexibility, balance, and overall well-being. Yoga can be practiced in a variety of environments and can be supplemented using different types of equipment or props. Examples of yoga equipment include (i) a floor mat to provide cushioning and grip for the hands and feet, (ii) yoga blocks that can be used for support and to assist in various poses, (iii) yoga straps to assist in stretches, (iv) yoga bolsters to support the body in restorative and seated poses, and (v) yoga balls to assist in balance and core-strengthening exercises.

OVERVIEW

A yoga block, also known as a yoga brick, is an exercise prop commonly used in yoga practice to provide support and stability during various poses. Yoga blocks are traditionally made of foam or cork and come in a variety of sizes and densities. They are often used to assist with proper alignment, balance, and range of motion during yoga practice. For example, yoga blocks can be placed under the hands, feet, or seat in various poses to provide added support and stability. In floor poses, yoga blocks can be used to elevate the hips or back and bring the floor closer to the body for added comfort. Further, yoga blocks can be used to deepen stretches by placing them under the arms or legs.

Some yoga exercises or poses may cause the practitioner's wrists to bend in non-ideal directions, thereby placing excessive stress on the wrists. To the extent the practitioner has experienced a wrist injury, such poses may be impossible to maintain and prevent the ongoing practice of yoga. Some practitioners try to overcome these challenges by placing a yoga block under the practitioner's hands and using the block to support a significant amount of the practitioner's body weight. Such maneuvers are not ideal when using conventional yoga blocks as these blocks do not adequately support the wrists, may cause discomfort, and are frequently unstable, which can result in rolling or slipping.

To address these shortcomings of conventional yoga blocks, particularly with respect to additional wrist support, some yoga blocks have been redesigned to include a handle that can be gripped by a yoga practitioner when exercising. The handle may allow the practitioner to rotate their wrist at different angles so that the practitioner can maintain a comfortable wrist angle in various poses. Additionally, the handle may allow for an improved grip, which can help the practitioner maintain proper body alignment and reduce the risk of injury.

However, existing yoga blocks with handles still have a number of deficiencies depending on their design. For example, some existing yoga blocks have handles that are made from the same flexible or soft material as the body of the yoga block. Such materials may not be well-suited for handles as they may break under stress, such as when placing a significant amount of body weight on the handles in various yoga poses. And even if the handles do not break, they may flex in the practitioner's grip, which can negatively impact the practitioner's ability to effectively or safely practice yoga. To reinforce such handles and help prevent them from breaking or flexing, some existing yoga blocks are designed to have thicker and bulkier handles that are made from the soft body material. While these handles may have increased strength and reduced flexibility, their bulk may make them difficult to grip, which may likewise result in a poor experience for the yoga practitioner.

Other existing yoga blocks may have handles constructed of rigid materials such that they do not suffer from the same drawbacks as the handles made from flexible or soft materials. However, these yoga blocks have their own drawbacks. For instance, as noted above, yoga blocks are typically made of softer materials, such as foam or cork, as these materials may provide a more comfortable experience for the yoga practitioner when performing poses that involve pressing various parts of the body against the blocks. But coupling a rigid handle material to a softer yoga block material can be a difficult task, and existing yoga blocks with rigid handles have addressed this problem by constructing the entire yoga block using rigid materials. This can make the yoga block unsuitable for poses that involve laying on the yoga blocks or otherwise pressing the practitioner's body against the blocks, such as restorative poses.

To help address the aforementioned and other problems, disclosed herein are new techniques for constructing yoga blocks with handles. The present designs include a rigid support member embedded within the body material of the yoga block with a handle grip coupled to the rigid support member. In such an arrangement, when a yoga practitioner grips the handle and places some or all of their body weight on the handle, the force of the weight is largely transferred to the support member instead of the body material of the yoga block. This allows the yoga block to have a rigid handle while still using soft or flexible materials for the body of the yoga block.

Further, the presence of the structural support member allows for removal of portions of the yoga block body material without compromising the structural integrity of the block. For instance, the yoga block may include a concavity where the handle is positioned, and the concavity may extend into a significant depth of the yoga block and/or along an entire lateral axis of the yoga block. Such a large concavity may provide additional space around the handle, which may allow for easier gripping of the handle and for greater range of motion around the handle than can be achieved using existing yoga blocks.

Another feature of the present invention is that the handle is designed to be flush with the other surfaces of the yoga block such that the practitioner can use the block in the exact same manner as traditional yoga blocks. Unlike other blocks with handles, the present invention is designed so that the handle is unobtrusive and maintains the utility of a traditional yoga block design.

In accordance with the above, in one aspect, disclosed herein is a yoga block comprising a body formed of a material having a top surface, a bottom surface, a first lateral surface extending between the top and bottom surfaces, a second lateral surface extending between the top and bottom surfaces, and a concavity in the top surface extending between the first and second lateral surfaces. The yoga block further comprises a handle having a grip portion and a structural support portion coupled to opposing ends of the grip portion, where the structural support portion is disposed at least partially within the body material, and the grip portion of the handle is disposed at least partially within the concavity of the body material.

In some examples, the structural support portion of the handle comprises (i) a first structural support portion that extends vertically through the body material between the first lateral surface and the concavity, (ii) a second structural support portion that extends horizontally through the body material between the bottom surface and the concavity, and (iii) a third structural support portion that extends vertically through the body material between the second lateral surface and the concavity.

In some examples, the structural support portion of the handle further comprises (i) a fourth structural support portion that extends through the body material diagonally upward from the second structural support portion to the first structural support portion and (ii) a fifth structural support portion that extends through the body material diagonally upward from the second structural support portion to the third structural support portion.

In some examples, a combined height of the first and fourth structural support portions is at least two-thirds the height of the body of the yoga block, and a combined height of the third and fifth structural support portions is at least two-thirds the height of the body of the yoga block.

In some examples, a length of the second structural support portion is (i) larger than a length of the grip portion of the handle and (ii) at least two-thirds the length of the body of the yoga block.

In some examples, a width of the second structural support portion is at least two-thirds the width of the body of the yoga block.

In some examples, the respective widths of the first, third, fourth, and fifth structural support portions are at least two-thirds the width of the body of the yoga block.

In some examples, the concavity is semi-cylindrical in shape such that the longitudinal axis of the semi-cylinder extends between the first and second lateral surfaces.

In some examples, a depth of the concavity is at least two-thirds the distance between the top and bottom surfaces of the body material. Further, in some examples, a depth of the concavity is at least three-fourths the distance between the top and bottom surfaces of the body material.

In some examples, the opposing ends of the grip portion of the handle extend partially into the body material, and the structural support portion of the handle is entirely disposed within the body material.

In some examples, a thickness of the body material between the top surface of the body material and the opposing ends of the grip portion that extend partially into the body material is no greater than five millimeters.

In some examples, the top and bottom surfaces of the body material are substantially parallel to one another and substantially orthogonal to the first and second lateral surfaces of the body material.

In some examples, the body comprises a rectangular prism of the body material having the concavity in a top surface of the rectangular prism. Further, in some examples, one or more edges or one or more corners of the rectangular prism are chamfered.

In some examples, a height of the yoga block is less than five inches. Further, in some examples, a height of the yoga block is less than four inches.

In some examples, the grip portion and the structural portion of the handle comprise wood, metal, or plastic.

In some examples, the body material comprises foam or cork.

In another aspect, disclosed herein is a method of exercise that includes (i) operatively positioning any of the yoga blocks described herein on a flat surface, and (ii) practicing a yoga position with the support of the yoga block while gripping the grip portion of the handle of the yoga block.

One of ordinary skill in the art will appreciate these as well as numerous other aspects in reading the following disclosure.

DETAILED DESCRIPTION

Figure 1A:
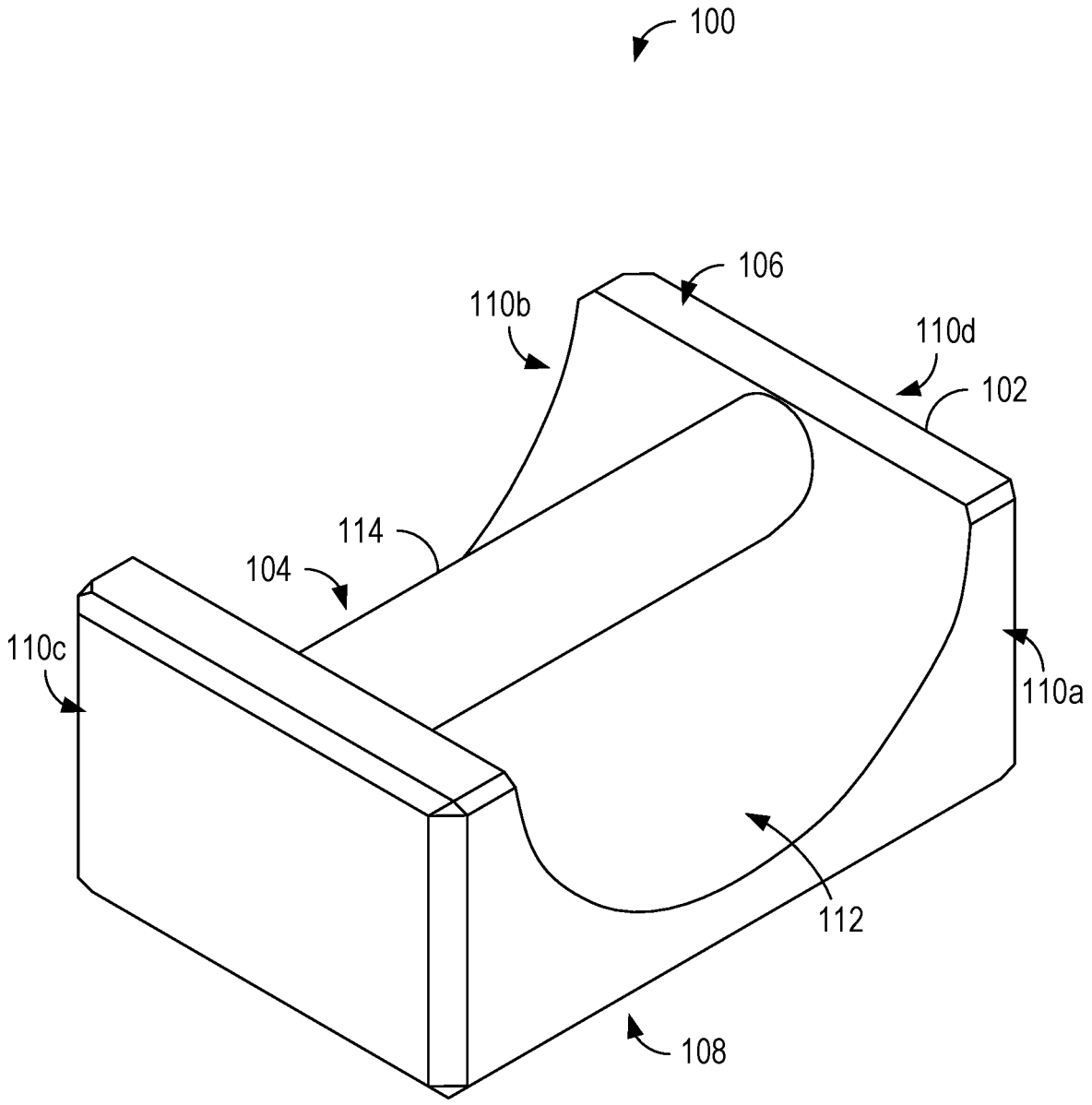
FIG. 1A depicts an isometric view of an example yoga block.

The following disclosure makes reference to the accompanying figures and several example embodiments. One of ordinary skill in the art should understand that such references are for the purpose of explanation only and are therefore not meant to be limiting. Part or all of the disclosed systems, devices, and methods may be rearranged, combined, added to, and/or removed in a variety of manners, each of which is contemplated herein.

I. EXAMPLE YOGA BLOCK

FIGS. 1A-4B depict various views of an example yoga block 100. Namely, FIGS. 1A and 1B respectively depict opaque and transparent isometric views of the yoga block 100; FIGS. 2A and 2B respectively depict opaque and transparent side views of the yoga block 100; FIGS. 3A and 3B respectively depict opaque and transparent top views of the yoga block 100; and FIGS. 4A and 4B respectively depict opaque and transparent front views of the yoga block 100.

As shown, the yoga block 100 includes a body 102 and a handle 104. The body 102 is made up of a body material. The body material can take various forms. In some examples, the body material may include soft, light, and/or flexible materials that are typically found in yoga blocks, such as cork or foam (e.g., ethylene-vinyl acetate (EVA) foam, styrofoam, thermoplastic elastomer (TPE) foam, neoprene foam, or other types of vinyl or rubber foams). In other examples, the body material may include more rigid materials, such as wood or plastic. However, as noted above, the use of rigid materials may make the yoga block 100 less suitable for certain restorative yoga poses that involve laying or sitting on the block 100.

The body 102 can take various shapes and sizes. As depicted, the body 102 can generally take the form of a rectangular prism. The prism can have a length of 10" or less, a width of 7" or less, and a height of 5" or less. In some examples, the height may be even smaller, such as 4" or less. In some examples, the prism can have dimensions that are typical of yoga blocks, such as 9"×6"×4", 9"×6"×3", or 9"×6"×3.5". Other dimensions and shapes are possible as well. Further, as depicted in the figures, any or all of the edges and/or corners of the body 102 may be chamfered to reduce their sharpness and increase the comfort of a yoga practitioner. Any or all of the edges and/or corners of the internal support structure may also be chamfered to reduce the likelihood of the support structure eroding the body material.

In the depicted example, the body 102 has a top surface 106, a bottom surface 108, and a number of lateral surfaces 110*a-d* (referred to herein collectively as lateral surfaces 110) that extend between the top surface 106 and the bottom surface 108. It should be understood that any directional references used herein (e.g., top, bottom, and lateral) are used for illustrative purposes to aid the reader's understanding of the present disclosure and are not meant to be limiting, particularly as to the position, orientation, or use of the disclosed yoga blocks.

The body 102 includes a concavity 112 formed in one or more of its surfaces. In the depicted example, the concavity 112 is formed in the top surface 106. The concavity 112 can take various shapes and sizes. As shown, the concavity 112 can take the form of a semicylinder with its longitudinal axis extending entirely between lateral surface 110*a* and lateral surface 110*b*, such that the concavity traverses the entire width of the body 102. And as further shown, the concavity 112 can extend along a majority of one or both of the length and height of the body 102. For instance, in some examples, the width of the concavity 112 may be greater than one-half, two-thirds, or three-quarters of the length of the body 102. Likewise, the depth of the concavity 112 may be greater than one-half, two-thirds, or three-quarters of the height of the body 102. However, in other examples, the concavity 112 may take other forms as well and may not traverse the entire width of the body 102. For instance, in some examples, the concavity 112 may take the form of a cylinder, an elliptic cylinder, a partial sphere, or a partial ellipsoid extending vertically into the top surface 106 of the body but without extending laterally to one or both of lateral surface 110*a* or lateral surface 110*b*. Still other examples are possible as well.

Figure 5:
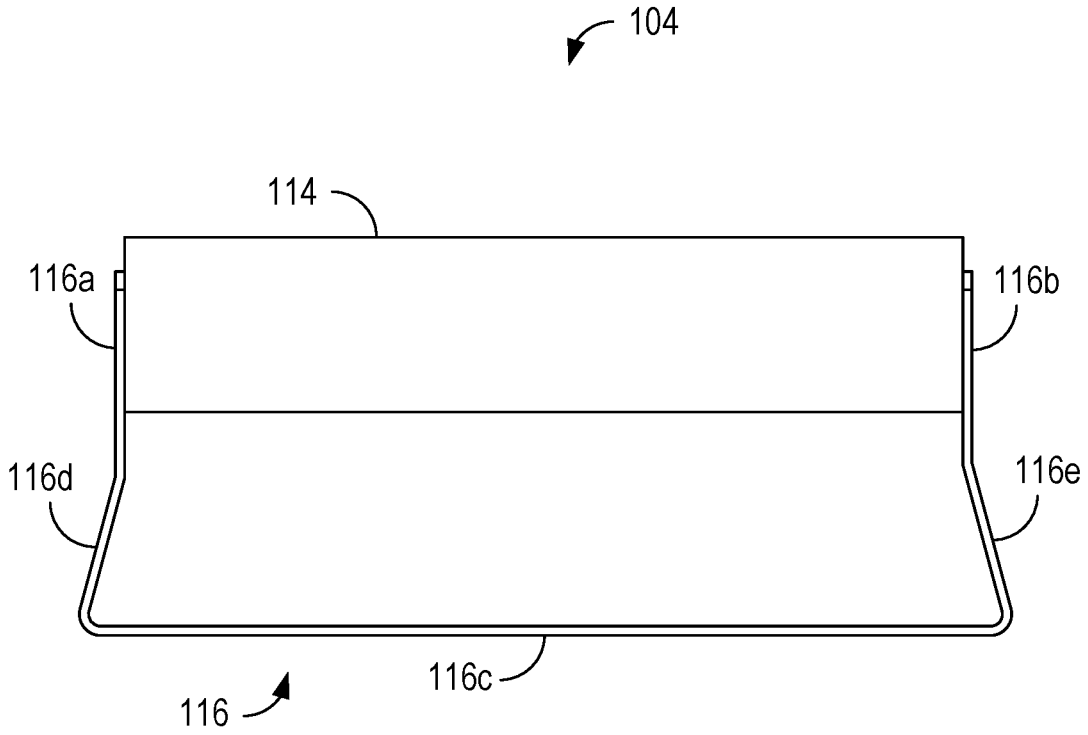
FIG. 5 depicts an example handle of an example yoga block.

The presence of the concavity 112 in the body 102 allows for the inclusion of the handle 104 in the body 102 of the yoga block 100. FIG. 5 depicts a side view of the handle 104 when it is isolated from the yoga block 100, but aspects of the handle 104 can also be seen in FIGS. 1A-3B and 4B. As shown, the handle 104 includes a grip 114 and a structural support 116 that is coupled to opposing ends of the grip 114. As used herein, references to connections (e.g., coupled) are to be construed broadly and may include intermediate members between a collection of elements and relative movement between elements unless otherwise indicated. As such, connection references do not necessarily infer that two elements are directly connected and in fixed relation to each other unless explicitly stated. The structural support 116 may be coupled to the grip 114 in any of various ways, such as by way of bolts, screws, welding, or adhesives. In some examples, the structural support 116 may couple to the grip 114 by including a rigid member that passes through a core of the grip 114. Any other apparent coupling techniques are contemplated herein as well.

The grip 114 and the structural support 116 may be comprised of various materials. In line with the discussion above, a rigid grip 114 that is resistant to flexing under stress may be advantageous when performing various yoga positions that involve putting significant weight on the handle 104. As such, the grip 114 may comprise a high strength material, such as metal, wood, or certain plastics. However, the grip 114 may additionally include a layer of softer material, such as rubber or silicone, on its outer surface to provide a more comfortable gripping experience to the yoga practitioner. As further discussed above and as explained in further detail below, some or all of the forces exerted on the grip 114 may be transferred to the structural support 116, so the structural support 116 may likewise be comprised of a high strength material, such as metal, wood, or certain plastics.

Figure 1B:
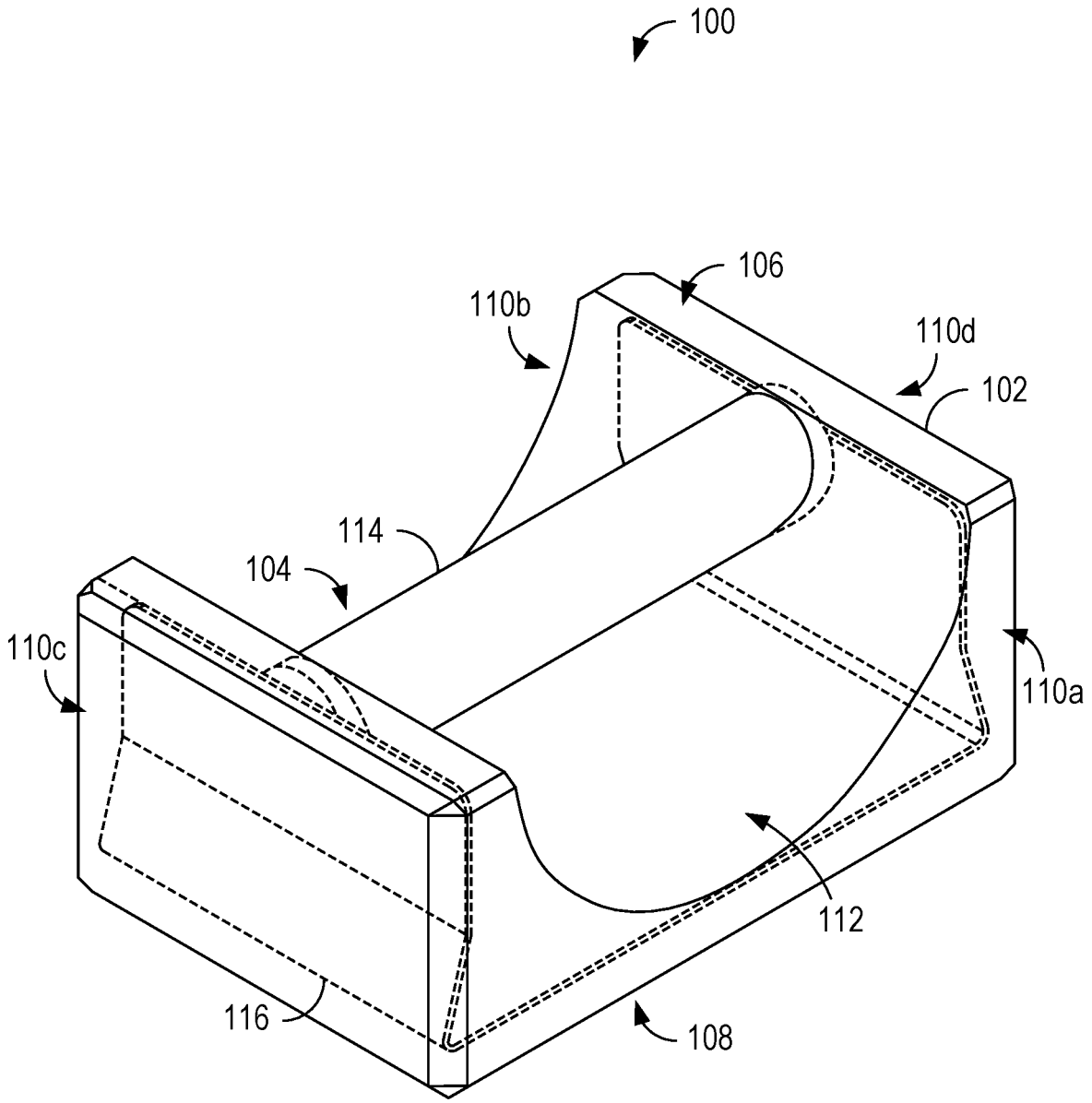
FIG. 1B depicts a transparent isometric view of the example yoga block of FIG. 1A.
Figure 2A:
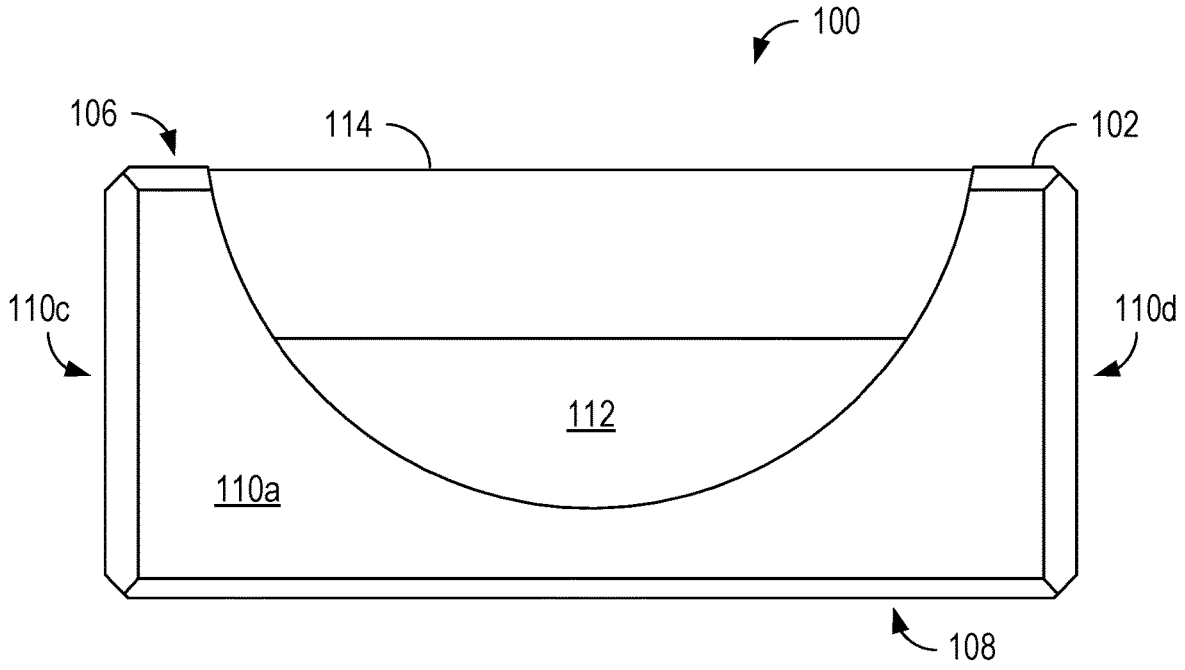
FIG. 2A depicts a side view of an example yoga block.
Figure 2B:
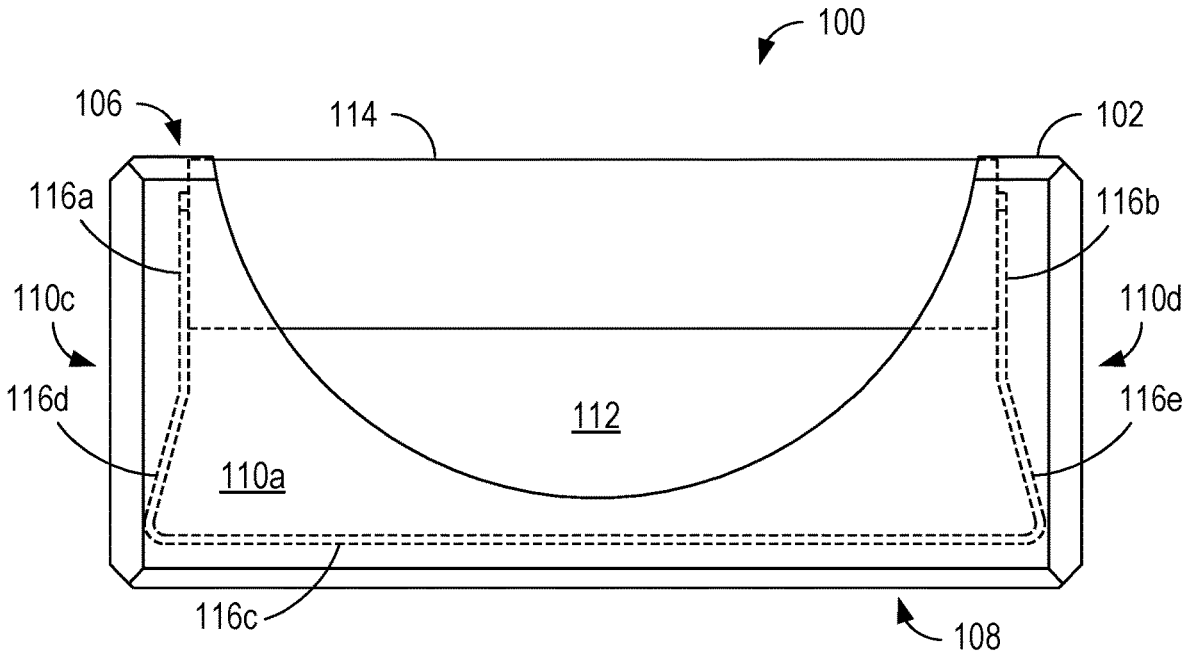
FIG. 2B depicts a transparent side view of the example yoga block of FIG. 2A.
Figure 3A:
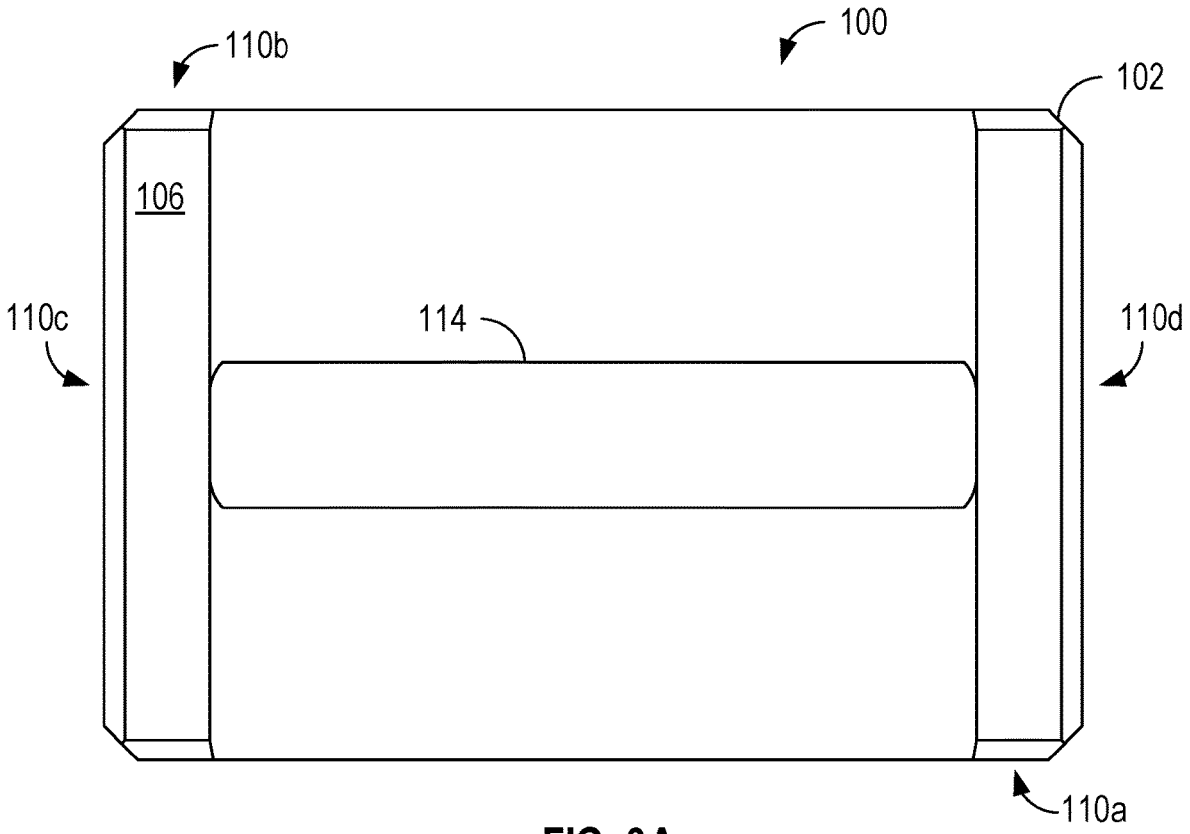
FIG. 3A depicts a top view of an example yoga block.
Figure 3B:
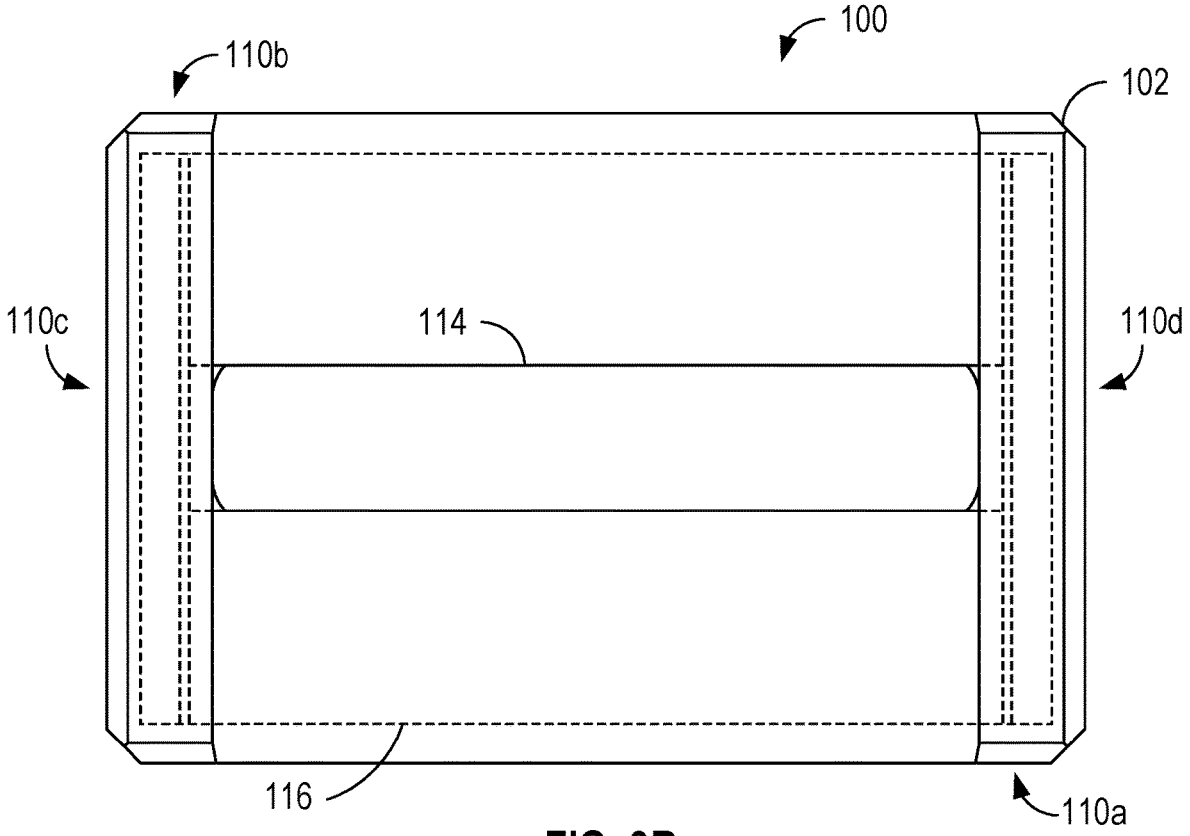
FIG. 3B depicts a transparent top view of the example yoga block of FIG. 3A.
Figure 4A:
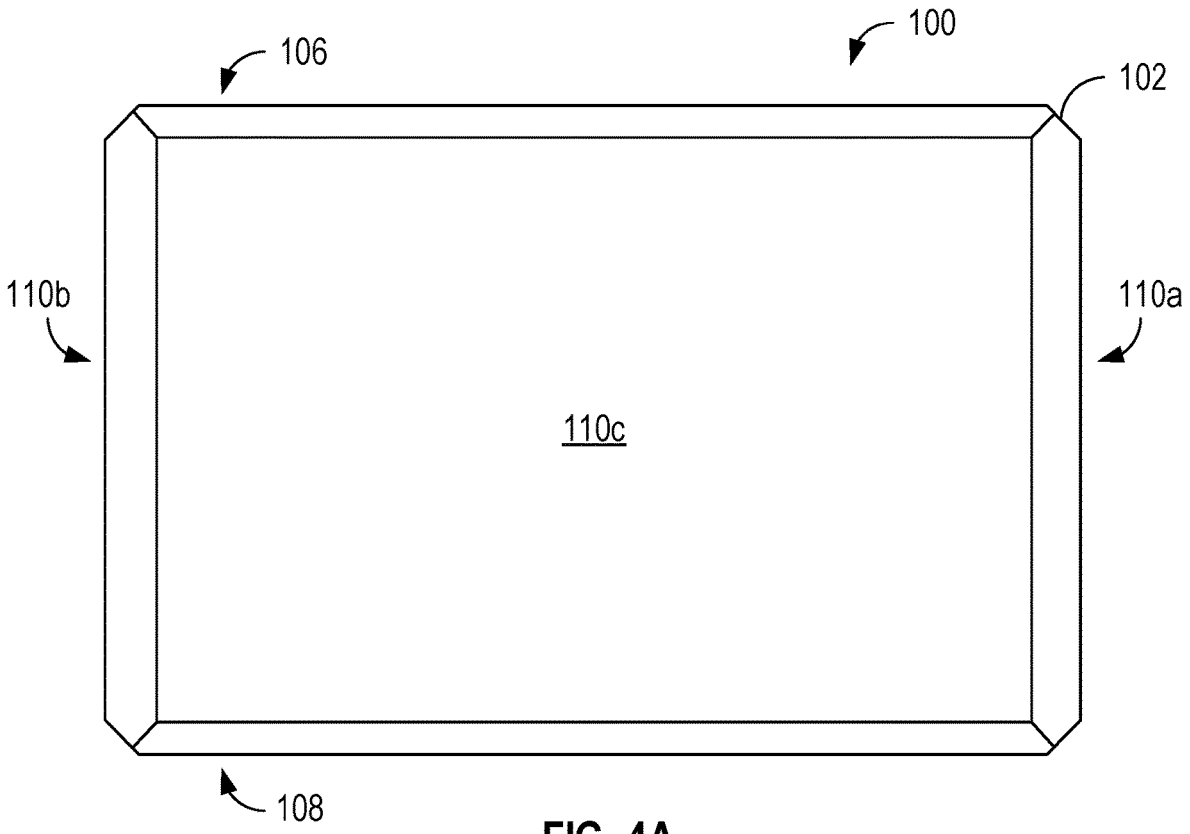
FIG. 4A depicts a front view of an example yoga block.
Figure 4B:
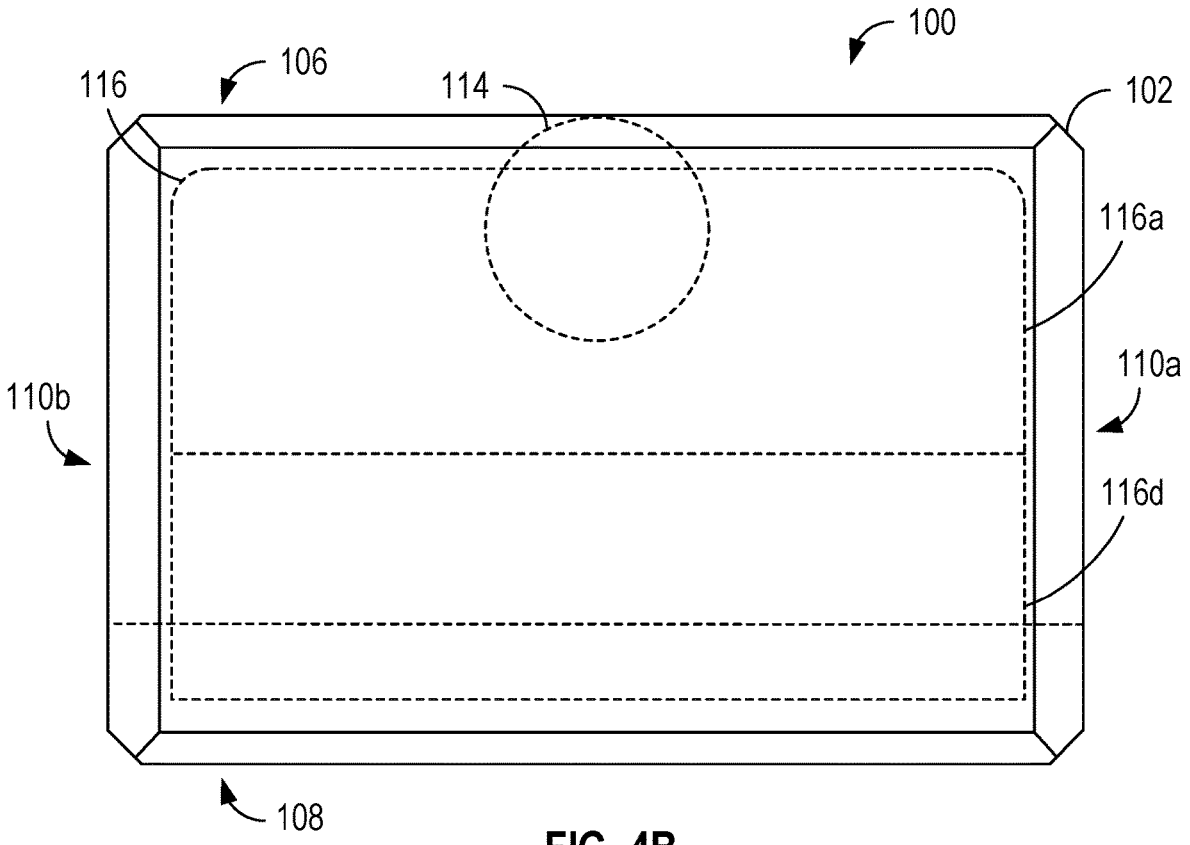
FIG. 4B depicts a transparent front view of the example yoga block of FIG. 4A.

The grip 114 may be largely or entirely positioned within the concavity 112 of the body 102, and the structural support 116 may be largely or entirely embedded within the material of the body 102. For instance, as shown in FIGS. 1B, 2B, and 3B, the opposing ends of the grip 114 can extend partially into the body material, such that the remainder of the grip 114 is exposed in the concavity 112, and the entirety of the structural support 116 is embedded in the body material. However, in other examples, the structural support 116 may extend partially into the concavity 112, such that the entirety of the grip 114 is exposed in the concavity 112, and the remainder of the structural support 116 is embedded in the body material.

The structural support 116 may be designed to have a particular shape for facilitating the transfer of forces from the grip 114. For instance, the structural support 116 may include support portions 116*a* and 116*b* that extend vertically downward from the opposing ends of the grip 114 and that are coupled to support portion 116*c*, which extends horizontally underneath and parallel to the grip 114. As shown in the figures, the horizontal support portion 116*c* may be longer than the grip 114, such that the structural support 116 includes support portions 116*d* and 116*e* that extend diagonally upward from the horizontal support portion 116*c* and inward toward the grip 114 in order to couple the horizontal support portion 116*c* to the vertical support portions 116*a* and 116*b*. With this design, the structural support 116 has a triangular base, which can help increase the amount of weight that the structural support 116 is able to bear. However, the structural support 116 may take other forms as well. As one example, the horizontal support portion 116*c* may be approximately the same length as the grip 114, such that the vertical support portions 116*a* and 116*b* extend all the way down and directly couple to the horizontal support portion 116*c*. As another example, the horizontal support portion 116*c* may be shorter than the grip 114, such that support portions 116*d* and 116*e* that extend diagonally upward and outward from the horizontal support portion 116*c* in order to couple the horizontal support portion 116*c* to the vertical support portions 116*a* and 116*b*. As yet another example, the structural support 116 may have a semicircular or semielliptical cross section with its ends terminating at opposing ends of the grip 114.

As noted above, the structural support 116 may be largely or entirely embedded within the body material of the yoga block 100. This can be accomplished in various ways. In some examples, the body 102 may be fabricated around the structural support 116 using injection molding processes. In other examples, the body 102 may be fabricated in multiple pieces that are then assembled around the structural support 116 and secured together using adhesive or any other apparent coupling mechanism.

With this arrangement, the support portion 116 acts as an internal skeletal support system that frames the concavity 112 of the yoga block 100. For instance, in the example yoga block 100 depicted in the figures, support portion 116*a* extends vertically through the body material between lateral surface 110*c* and the concavity 112, support portion 116*b* extends vertically through the body material between lateral surface 110*d* and the concavity 112, support portion 116*c* extends horizontally through the body material between the bottom surface 108 and the concavity 112, support portion 116*d* extends from support portion 116*c* to support portion 116*a* diagonally upward through the body material between lateral surface 110*c* and the concavity 112, and support portion 116*e* extends from support portion 116*c* to support portion 116*b* diagonally upward through the body material between lateral surface 110*d* and the concavity 112.

In order to increase the amount of structural integrity provided by the structural support 116, certain dimensions of the structural support 116 may be configured to traverse a majority or significant majority of certain dimensions of the body 102 of the yoga block 100. For instance, a combined height of support portion 116*a* and 116*d* and/or a combined height of support portion 116*b* and 116*e* may be at least one-half the height of the body 102, at least two-thirds the height of the body 102, or at least three-quarters the height of the body 102. A length of the horizontal support portion 116*c* may be at least one-half the length of the body 102, at least two-thirds the length of the body 102, or at least three-quarters the length of the body 102. Further, a width of any or all of the structural support portions 116*a-e* may be at least one-half the width of the body 102, at least two-thirds the width of the body 102, or at least three-quarters the width of the body 102.

In line with the discussion above, the internal support provided to the yoga block 100 by the structural support 116 allows for design considerations that were not feasible in existing yoga block designs. For instance, as noted above, when using the present yoga block 100 to practice yoga, the components of the handle 104 (i.e., the grip 114 and the structural support 116) bear the brunt of any external forces applied to the yoga block 100, and the amount of force borne by the body 102 of the yoga block 100 are minimal in comparison. As a result, large portions of the body 102 can be removed without compromising the structural integrity of the yoga block 100. Namely, the concavity 112 can be much larger, such as be extending deeper into the body 102 and/or extending across a greater portion or the entirety of the width of the body 102, than was previously possible. And, as further noted above, providing a larger concavity 112 may result in an improved exercise experience by allowing the yoga practitioner to more easily and securely grip the handle grip 114 and by allowing for a greater range of angles at which the practitioner may access the handle grip 114.

In addition to the above, various other design considerations may be implemented to allow the yoga block 100 to be used as a conventional yoga block without a handle, if so desired by the practitioner. For instance, as shown in FIGS. 2A and 2B, the top of the grip 114 may be flush or substantially flush with the top surface 106 of the body 102. The top of the grip 114 is considered to be substantially flush with the top surface 106 when the opposing ends of the grip 114 that extend into the body material are covered by a thin layer of the body material. In some examples, the thickness of the body material between the top surface 106 and the opposing ends of the grip 114 that extend partially into the body material is no greater than five millimeters, no greater than three millimeters, or no greater than one millimeter.

With the grip 114 being flush or substantially flush to the top surface 106, the yoga practitioner may position the yoga block 100 in an upside down orientation, such that the grip 114 is adjacent to the floor or some other flat surface of the exercise environment. In this arrangement, the bottom surface 108 of the yoga block 100 is facing upwards towards the practitioner and acts as a flat, smooth surface similar to what a traditional yoga block provides, while the grip 114 provides structural support for the yoga block 100 when it is pressed against the floor.

II. EXAMPLE METHODS OF USE

The present disclosure further contemplates various methods of exercising using any of the examples of the yoga block 100 described above.

One example method of exercising involves operatively positioning the bottom surface 108 of the yoga block 100 on a flat surface, such as a floor or yoga mat. The method further involves a yoga practitioner gripping the grip 114 of the handle 104 and practicing a yoga position with the support of the yoga block 100 while gripping the grip 114.

Another example method of exercising involves operatively positioning the top surface 106 of the yoga block 100 on a flat surface, such as a floor or yoga mat. The method further involves a yoga practitioner placing a hand, foot, or other body member against the bottom surface 108 of the yoga block 100 and practicing a yoga position with the support of the yoga block 100.

Yet another example method of exercising involves operatively positioning any of the lateral surfaces 110 of the yoga block 100 on a flat surface, such as a floor or yoga mat. The method further involves a yoga practitioner placing a hand, foot, or other body member against the yoga block 100 and practicing a yoga position with the support of the yoga block 100.

III. CONCLUSION

Example embodiments of the disclosed innovations have been described above. Those skilled in the art will understand, however, that changes and modifications may be made to the embodiments described without departing from the true scope and spirit of the present invention, which will be defined by the claims.

The invention claimed is:

1. A yoga block comprising:

a body formed of a material having a top surface, a bottom surface, a first lateral surface extending between the top and bottom surfaces, a second lateral surface extending between the top and bottom surfaces, and a concavity in the top surface extending between the first and second lateral surfaces; and a handle having a grip portion and a structural support portion coupled to opposing ends of the grip portion;

wherein the structural support portion is embedded at least partially within the body material, and the grip portion of the handle is positioned at least partially within the concavity in the top surface.

2. The yoga block of claim 1, wherein the structural support portion comprises:

a first structural support portion that extends vertically through the body material between the first lateral surface and the concavity;

a second structural support portion that extends horizontally through the body material between the bottom surface and the concavity; and a third structural support portion that extends vertically through the body material between the second lateral surface and the concavity.

3. The yoga block of claim 2, wherein the structural support portion further comprises:

a fourth structural support portion that extends through the body material diagonally upward from the second structural support portion to the first structural support portion; and a fifth structural support portion that extends through the body material diagonally upward from the second structural support portion to the third structural support portion.

4. The yoga block of claim 3, wherein:

a combined height of the first and fourth structural support portions is at least two-thirds of a height of the body of the yoga block; and a combined height of the third and fifth structural support portions is at least two-thirds of a height of the body of the yoga block.

5. The yoga block of claim 4, wherein a length of the second structural support portion is (i) larger than a length of the grip portion of the handle and (ii) at least two-thirds of a length of the body of the yoga block.

6. The yoga block of claim 5, wherein a width of the second structural support portion is at least two-thirds of a width of the body of the yoga block.

7. The yoga block of claim 6, wherein respective widths of the first, third, fourth, and fifth structural support portions are at least two-thirds the width of the body of the yoga block.

8. The yoga block of claim 1, wherein the concavity is semi-cylindrical in shape such that a longitudinal axis of the semi-cylinder extends between the first and second lateral surfaces.

9. The yoga block of claim 1, wherein a depth of the concavity is at least two-thirds the distance between the top and bottom surfaces of the body.

10. The yoga block of claim 1, wherein a depth of the concavity is at least three-fourths of a distance between the top and bottom surfaces of the body.

11. The yoga block of claim 1, wherein the opposing ends of the grip portion of the handle extend partially into the body material, and the structural support portion of the handle is entirely embedded within the body material.

12. The yoga block of claim 11, wherein a thickness of the body material between the top surface of the body material and the opposing ends of the grip portion that extend partially into the body material is no greater than five millimeters.

13. The yoga block of claim 1, wherein the top and bottom surfaces of the body are substantially parallel to one another and substantially orthogonal to the first and second lateral surfaces of the body material.

14. The yoga block of claim 1, wherein the body comprises a rectangular prism having the concavity in a top surface of the rectangular prism.

15. The yoga block of claim 14, wherein one or more edges or one or more corners of the rectangular prism are chamfered.

16. The yoga block of claim 1, wherein one or more edges or one or more corners of the structural support portion are chamfered.

17. The yoga block of claim 1, wherein a height of the yoga block is less than five inches.

18. The yoga block of claim 1, wherein the grip portion and the structural support portion of the handle comprise wood, metal, or plastic.

19. The yoga block of claim 1, wherein the body material comprises foam or cork.

20. A method of exercising comprising:

operatively positioning the yoga block of claim 1 on a flat surface; and practicing a yoga position with support of the yoga block while gripping the grip portion of the handle of the yoga block.

* * * * *